US006276014B1

(12) United States Patent
Lee

(10) Patent No.: US 6,276,014 B1
(45) Date of Patent: Aug. 21, 2001

(54) TOOL COUPLER/KNIFE COMBINATION

(76) Inventor: Shu-Chen Lee, 3F, No. 1, Alley 3, Lane 80, Section 4, Min Sheng East Road, Taipei (TW)

( * ) Notice: Subject to any disclaimer, the term of this patent is extended or adjusted under 35 U.S.C. 154(b) by 0 days.

(21) Appl. No.: 09/499,139

(22) Filed: Feb. 7, 2000

(51) Int. Cl.[7] ..... B26B 11/00

(52) U.S. Cl. ..... 7/158; 7/165; 7/105; 7/138; 30/162

(58) Field of Search ..... 7/158, 105, 138, 7/165; 30/123, 162

(56) References Cited

U.S. PATENT DOCUMENTS 4,974,320 * 12/1990 Pelletier ..... 30/123
5,038,435 * 8/1991 Crawford et al. ..... 7/165
5,222,848 * 6/1993 Kuang-Wu ..... 409/239 R
5,502,896 * 4/1996 Chen ..... 30/162
5,528,831 * 6/1996 Fortenberry ..... 30/161
5,620,454 * 4/1997 Pierce et al. ..... 606/167
5,735,005 * 4/1998 Wang ..... 7/127
5,896,606 * 4/1999 Huang ..... 7/165
5,950,311 * 9/1999 Huang ..... 30/162
5,970,552 * 10/1999 Kwiecien et al. ..... 7/143
6,000,080 * 12/1999 Anderson et al. ..... 7/128
6,044,560 * 4/2000 Chao ..... 30/123
6,105,190 * 8/2000 Shiao ..... 7/165

* cited by examiner

*Primary Examiner*—James G. Smith
*Assistant Examiner*—Hadi Shakeri
(74) *Attorney, Agent, or Firm*—Alan Kamrath; Rider, Bennett, Egan & Arundel, LLP

(57) ABSTRACT

A tool coupler/knife combination includes a sleeve and a casing slidably mounted in the sleeve and having a blade mounted therein. The blade is slidable relative to the casing to a positioning in which an end of the blade is exposed for cutting. A tool coupler is mounted to the sleeve for releasably engaging with a tool bit. The casing includes a receptacle for receiving a telescopic rod with a magnetic end for attracting screws. Longitudinal position of the casing relative to the sleeve may be adjusted to thereby change the arm of force for cutting objects or driving fasteners.

14 Claims, 9 Drawing Sheets

TOOL COUPLER/KNIFE COMBINATION

BACKGROUND OF THE INVENTION

1. Field of the Invention

The present invention relates to a tool coupler/knife combination, and more particularly to a combination of a knife and a tool coupler to which a tool bit is engaged.

2. Description of the Related Art

A so-called art designer knife is usually used to cut paper, thin plastic boards, thin wood, plastic tubes, wires, etc. Nevertheless, the blade of an art designer knife is often stuck in the object during cutting, as current art designer knives are not easy to grasp and thus difficult to apply larger force. The knife provides a single function of cutting. Screwdrivers are one of the most frequently used tools, yet carriage thereof is a problem. Screws might fall into a narrow slit and thus may be difficult to be retrieved by fingers or pliers. Problems might occur accordingly.

The present invention is intended to provide a tool coupler/knife combination that mitigates and/or obviates the above problems.

SUMMARY OF THE INVENTION

It is a primary object of the present invention to provide a tool coupler/knife combination that allows firm grasp by the user.

It is another object of the present invention to provide a tool coupler/knife combination that may engage various tool bits for convenient use.

It is a further object of the present invention to provide a tool coupler/knife combination that may be adjusted to provide a longer arm of force for cutting objects or driving fasteners.

It is still another object of the present invention to provide a tool coupler/knife combination with a telescopic rod having a magnetic end for attracting screws or the like.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
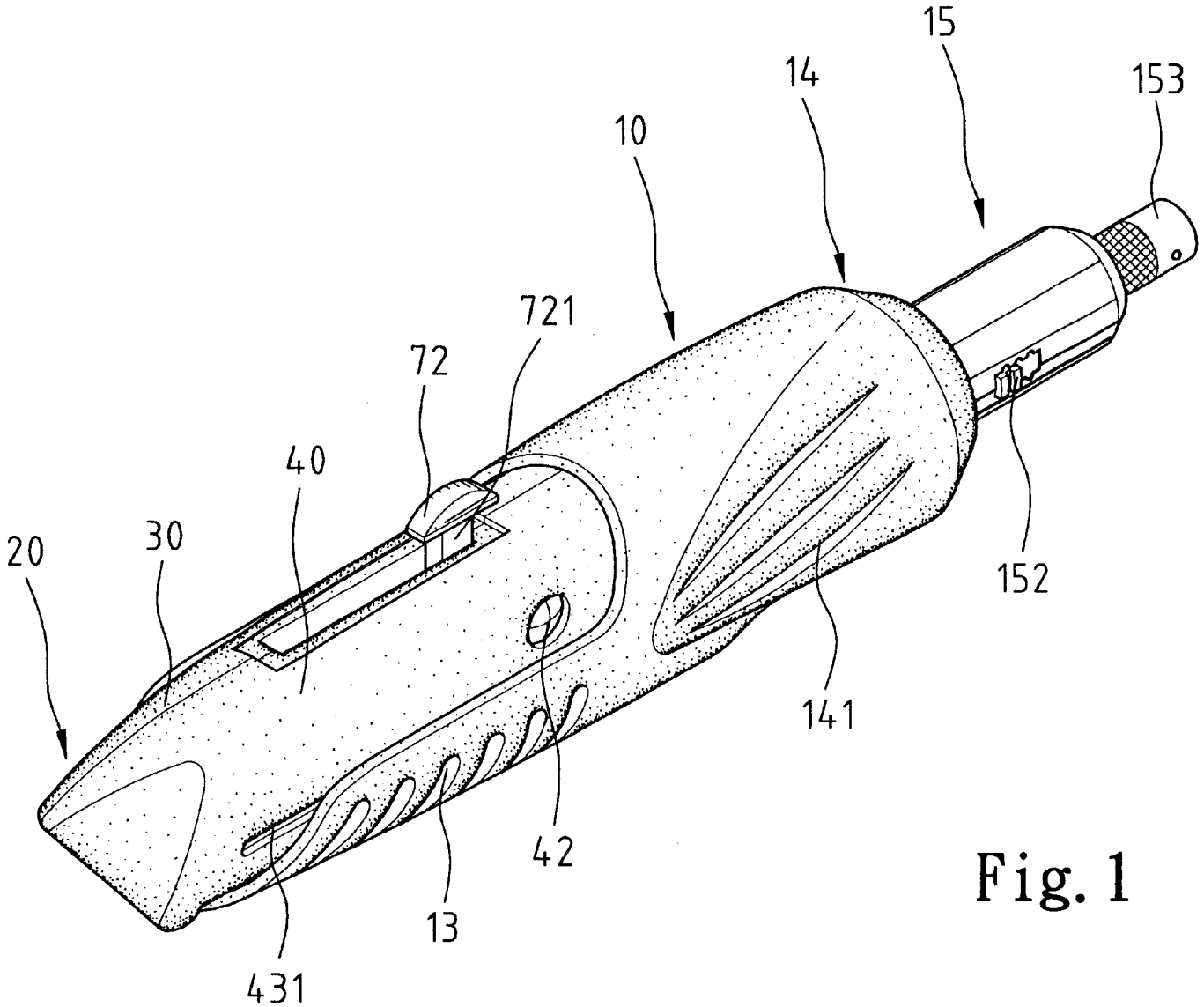
FIG. 1 is a perspective view of a tool coupler/knife combination in accordance with the present invention.

Referring to FIGS. 1 through 4, a tool coupler/knife combination in accordance with the present invention generally includes a sleeve 10, a blade kit 70, a casing 20, and a tool bit coupler 15. The sleeve 10 includes a compartment 11 therein and a pair of positioning devices 12 arranged on two inner lateral walls of the sleeve 10. Each positioning device 12 is in the form of a rail having a number of longitudinally spaced protrusions 121 and 122, which will be described later. The sleeve 10 may have a cutout (not labeled) in one end thereof. The end of the sleeve 10 may include a number of recesses 13 on an underside thereof for easy and firm grasp. The tool bit coupler 15 is mounted to the other end of the sleeve 10. In this embodiment, the other end of the sleeve 10 acts as a handle and includes a number of recesses 141 for easy and firm grasp. The tool bit coupler 15 includes a threaded first end 151 for engaging with a screw hole 142 in the other end 14 of the sleeve 10. The tool bit coupler 15 further includes a bit holder 153 on a second end thereof for releasably engaging with a tool bit. The tool bit coupler 15 may further include a ratchet shifter 152 to switch the direction for driving fasteners.

The blade kit 70 includes a blade holder 71 and a thumb piece 72. A blade 73 is mounted in the blade holder 71 and enclosed by upper and lower walls 711 and 712 of the blade holder 70 in a manner that the blade 73 cannot move in a vertical direction. The blade 73 has two recesses 732 and 734 in an upper side thereof. The upper wall 711 includes an engaging piece 713 for engaging with, e.g., recess 732 such that an end of the blade 73 may be used for cutting. When the end of the blade 73 becomes dull, the user may disengage the blade 73 from blade holder 71 and then flip-flop the blade 73 and re-insert the blade 73 into the blade holder 71 in a manner that the engaging piece 713 engages in the other recess 734 such that the other unused end of the blade 73 may be used.

Figure 2:
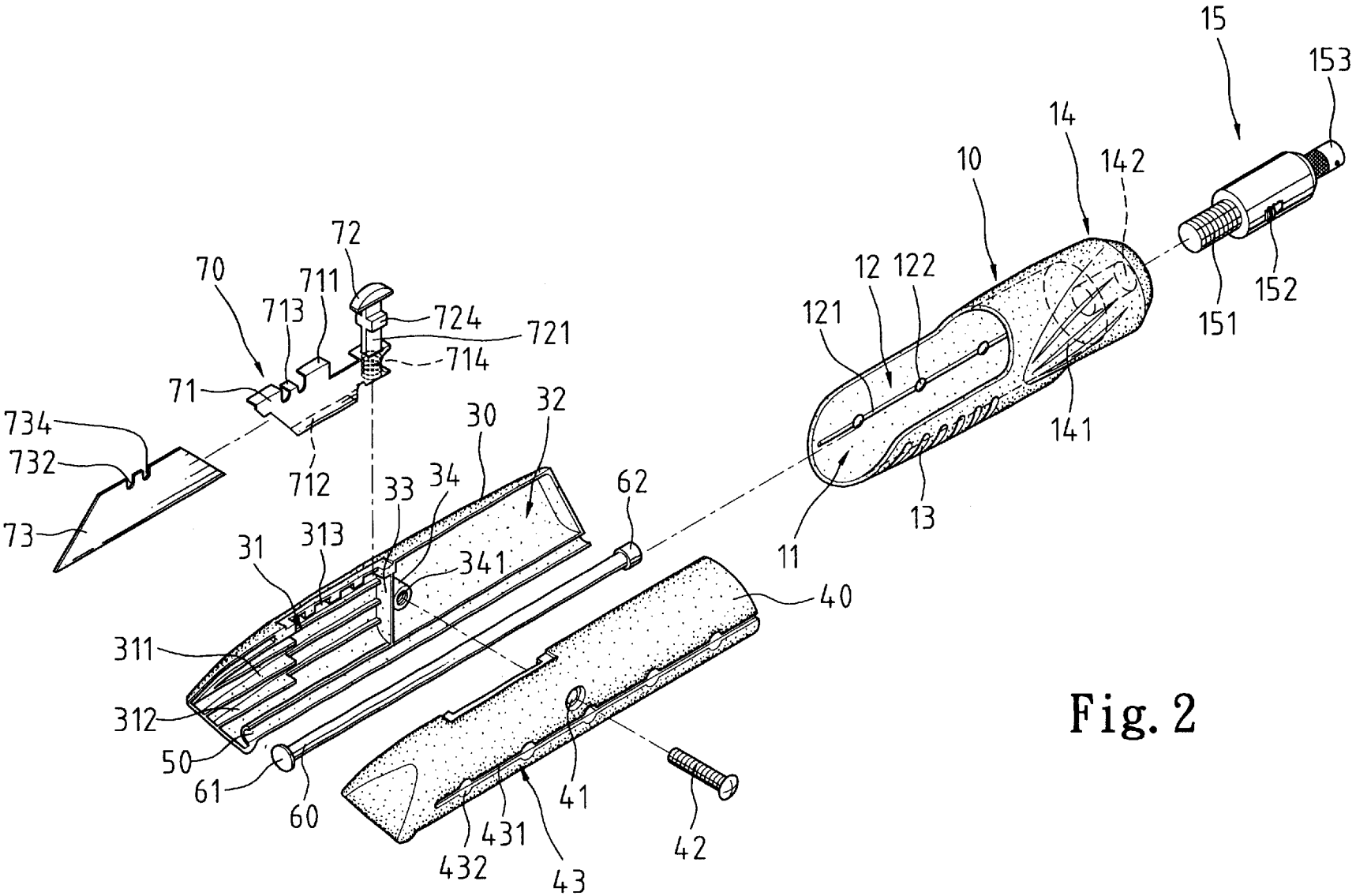
FIG. 2 is an exploded perspective view of the tool coupler/knife in accordance with the present invention.
Figure 5:
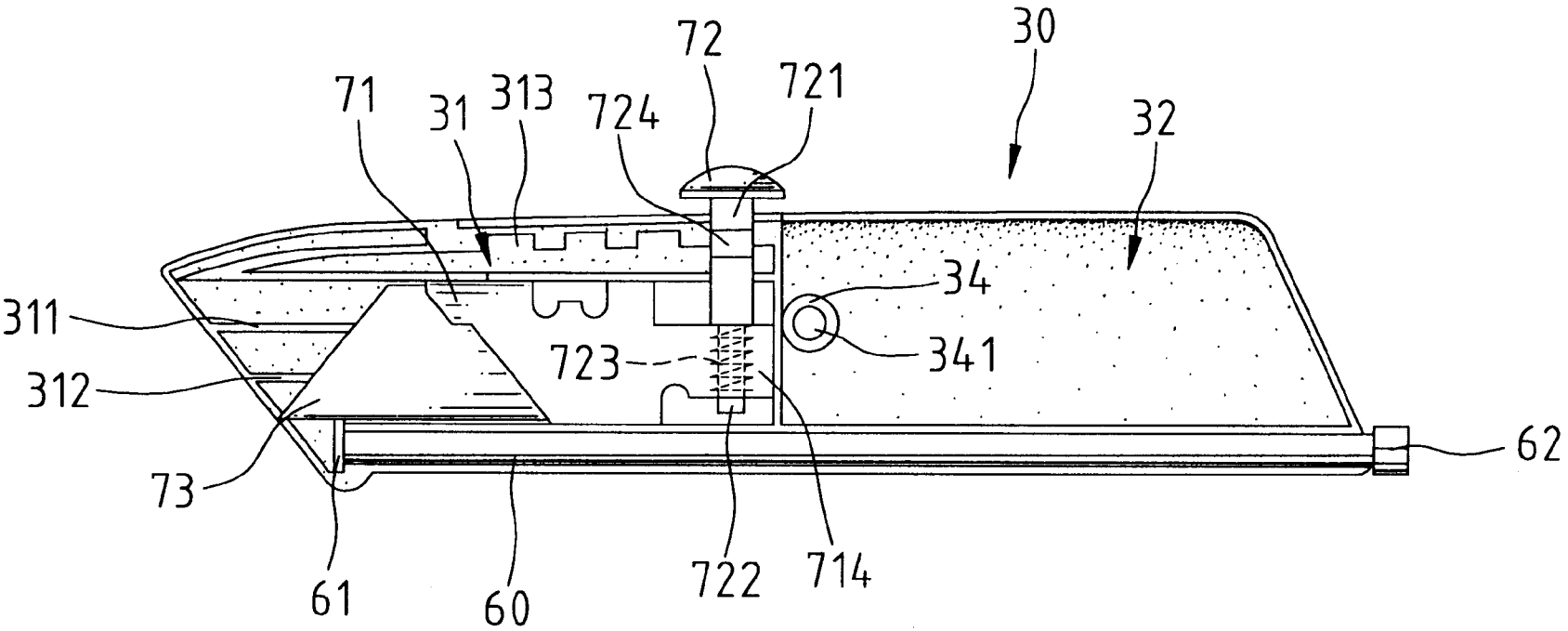
FIG. 5 is a sectional view taken along line A—A in FIG. 3.

As illustrated in FIGS. 2 and 5, the thumb piece 72 includes a positioning member 721 and an engaging stem 722 extended from the positioning member 721. The positioning member 721 further includes two protrusions 724 formed on two sides thereof, respectively, which will be described later. The blade holder 71 includes a fixing seat 714 to which the engaging stem 722 is slidably mounted. An elastic element 723 is mounted around the engaging stem 722 for biasing the thumb piece 72 away from the fixing seat 714. Thus, the thumb piece 72 may be pressed downward, as the engaging stem 722 is slidably guided by the fixing seat 714 in the vertical direction. The engaging stem 722 may include a stop or flange (not shown) located below the underside of the fixing seat 714 to thereby prevent disengagement of the thumb piece 72 from the fixing seat 714.

The casing 20 includes a first casing half 30 and a second casing half 40. Each casing half 30, 40 includes a partitioning member 33, thereby separating an interior of the casing half 30, 40 into a front chamber 31 and a rear chamber 32. The front chamber 31 includes a number of ribs 311 and 312 for receiving tool bits. The rear chamber 32 may receive spare blades 73 therein. The first casing half 30 further includes a stub 34 with a screw hole 341, and the second half casing 40 includes a through-hole 41. A screw 42 is extended through the through-hole 41 and the screw hole 341 to assemble the casing halves 30 and 40 together. Each casing half 30, 40 further includes a number of positioning recesses 313 for releasably engaging with the protrusions 724 of the thumb piece 72 to thereby retain the blade 73 in place. At least one of the casing halves 30 and 40 further includes a receptacle 50 for receiving a telescopic rod 60 that has an enlarged end 61 retained in the receptacle 50 and a magnetic second end 62. Each half casing 30, 40 further includes a groove track 43 in the form of a track 431 for slidably engaging with an associated rail 12 of the sleeve 10. Each track 431 has a number of positioning depressions 432 for releasably engaging with an associated protrusions 121, 122 of the rail 12, thereby allowing the sleeve 10 and the casing 20 to be adjusted in the longitudinal direction. Thus, the overall length of the tool coupler/knife combination can be adjusted to change the arm of force for cutting objects or driving fasteners.

Figure 3:
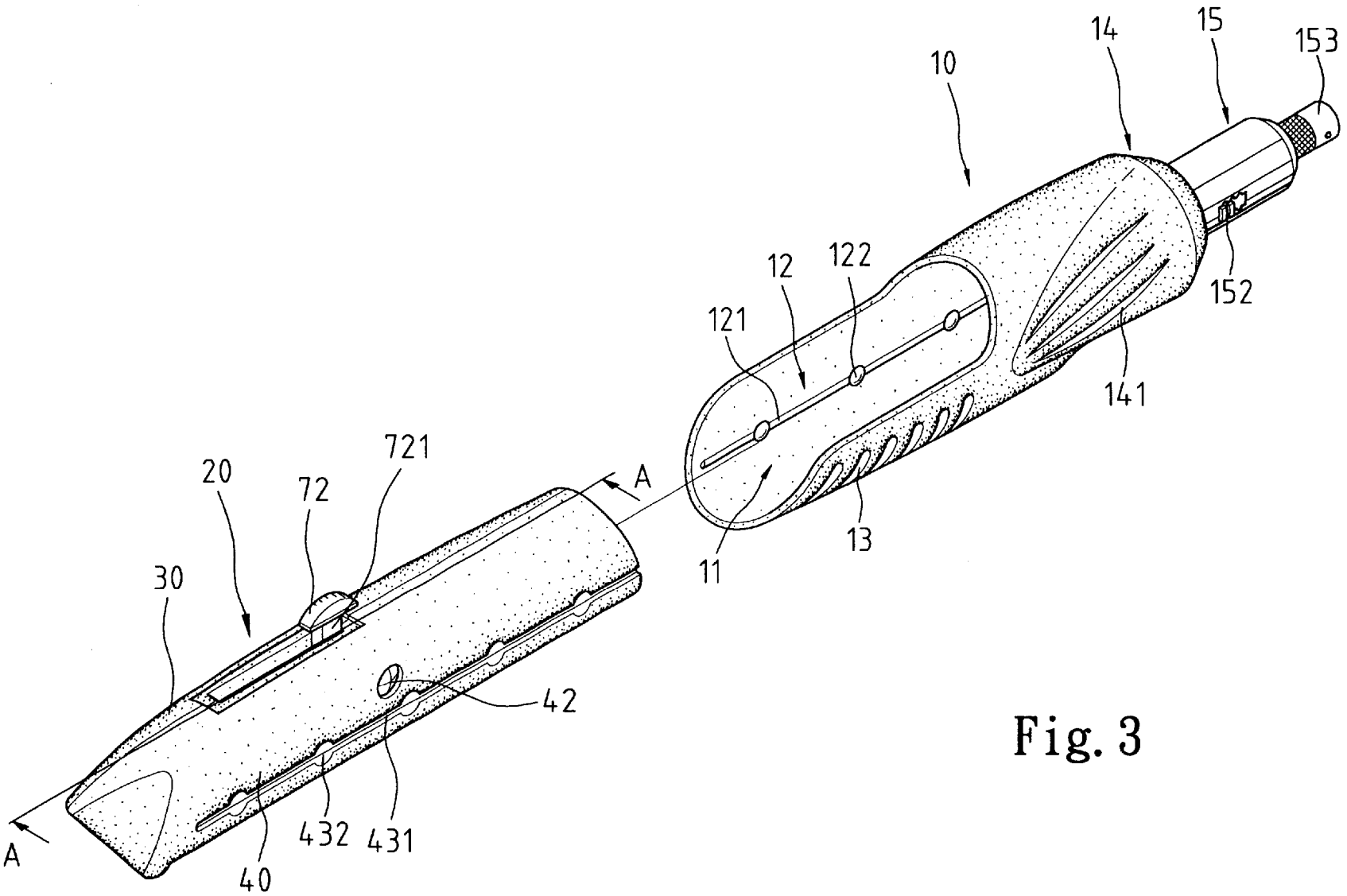
FIG. 3 is an exploded view similar to FIG. 2, wherein the casing for holding the knife is assembled.
Figure 4:
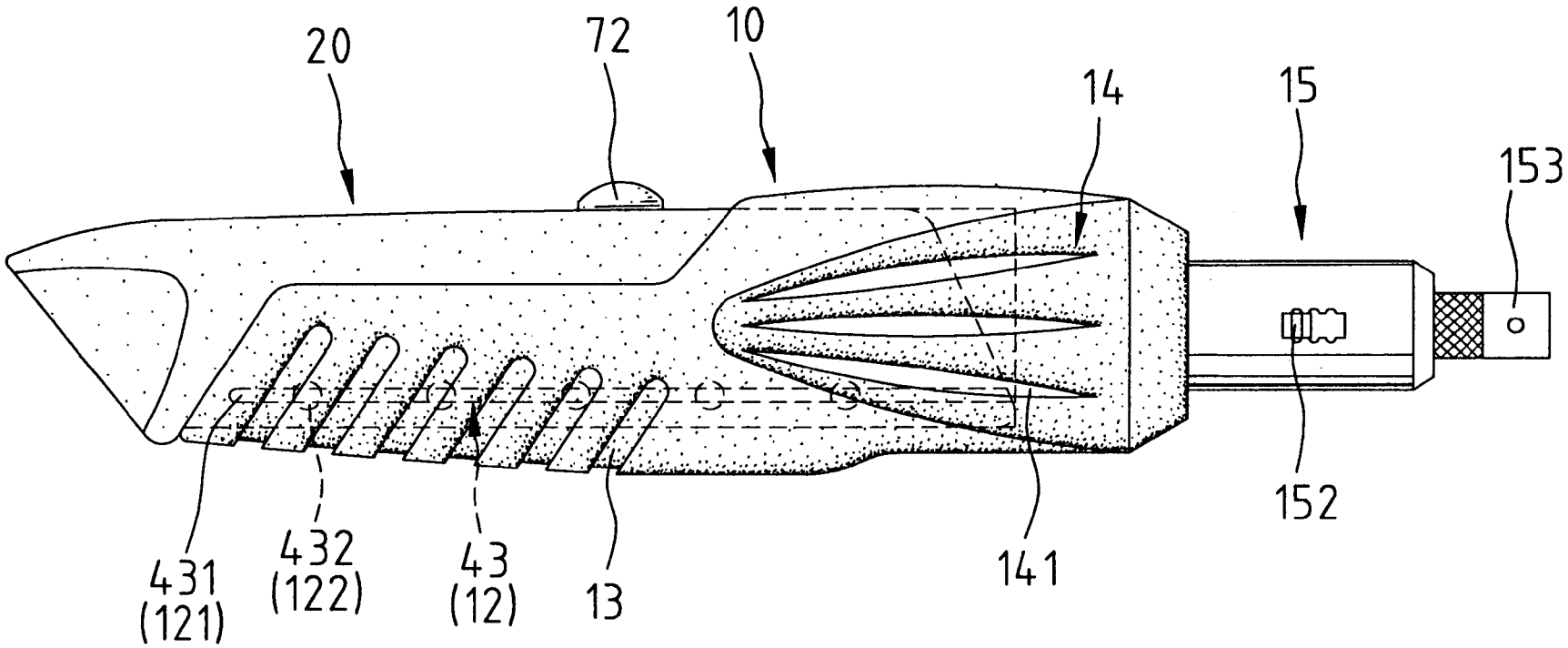
FIG. 4 is a side view of the tool coupler/knife combination in accordance with the present invention.
Figure 6:
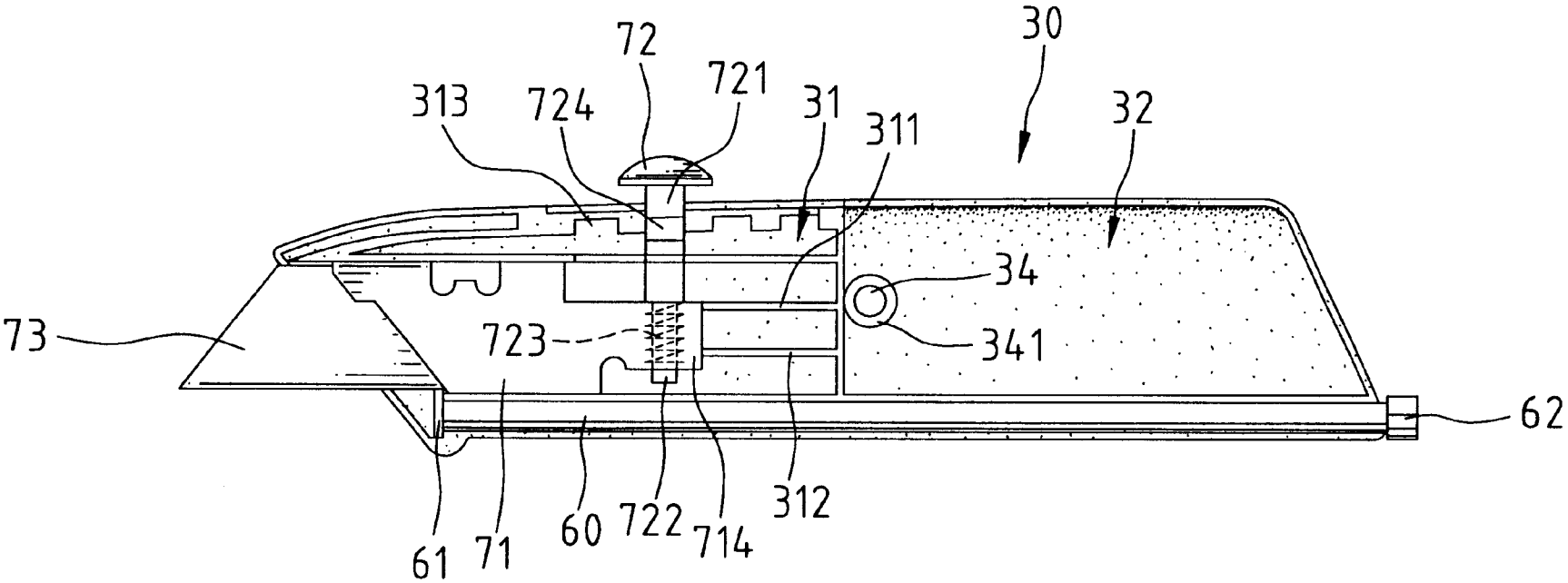
FIG. 6 is a view similar to FIG. 5, illustrating adjustment of position of the blade.

The blade 73 in FIGS. 3 and 4 is in a storage position in which the protrusions 724 of the positioning member 721 are engaged with a pair of innermost positioning recesses 313 of the casing 20. When in use, the thumb piece 72 is pushed downward and thus compresses the elastic element 723. The protrusions 724 of the positioning member 721 are disengaged from the innermost positioning recesses 313. Then, the thumb piece 72 is moved along the longitudinal direction until the blade 73 is exposed to a desired extent. Next, the thumb piece 72 is released, and the protrusions 724 of the positioning member 721 engage another pair of the positioning recesses 313 of the casing 20 under the action of the elastic element 723, best shown in FIG. 6.

Figure 7:
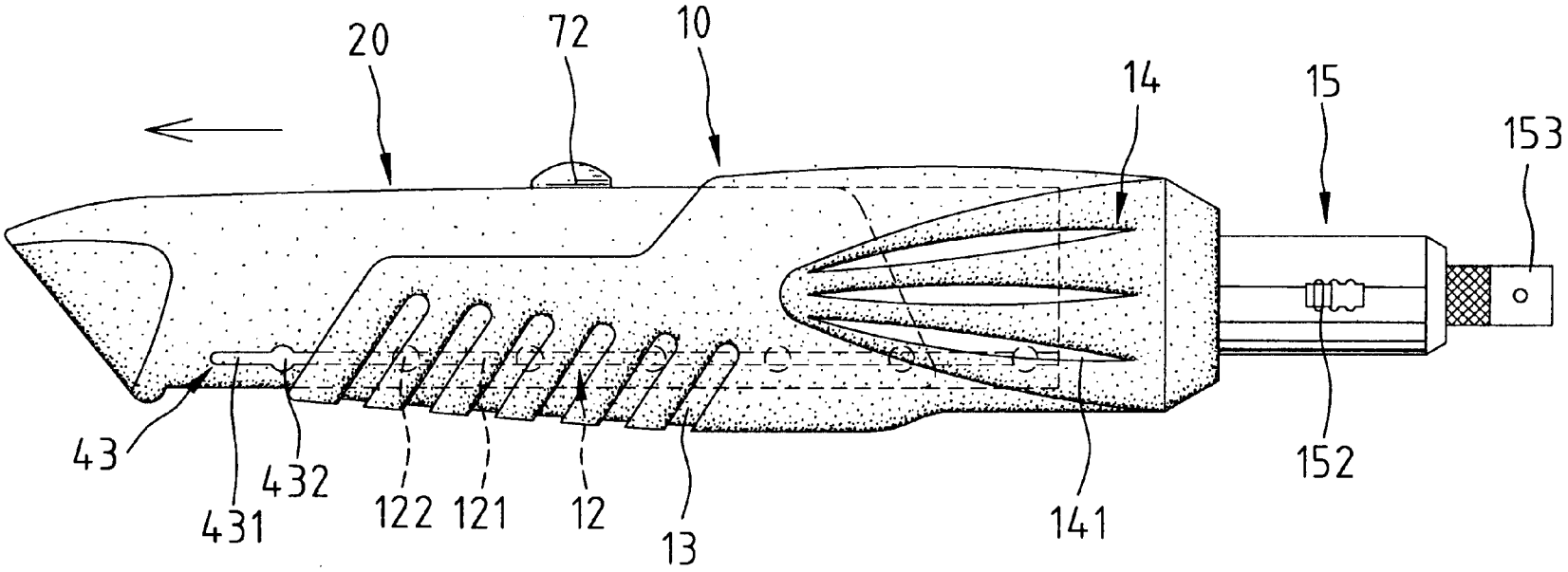
FIG. 7 is a view similar to FIG. 4, illustrating adjustment of arm of force.
Figure 8:
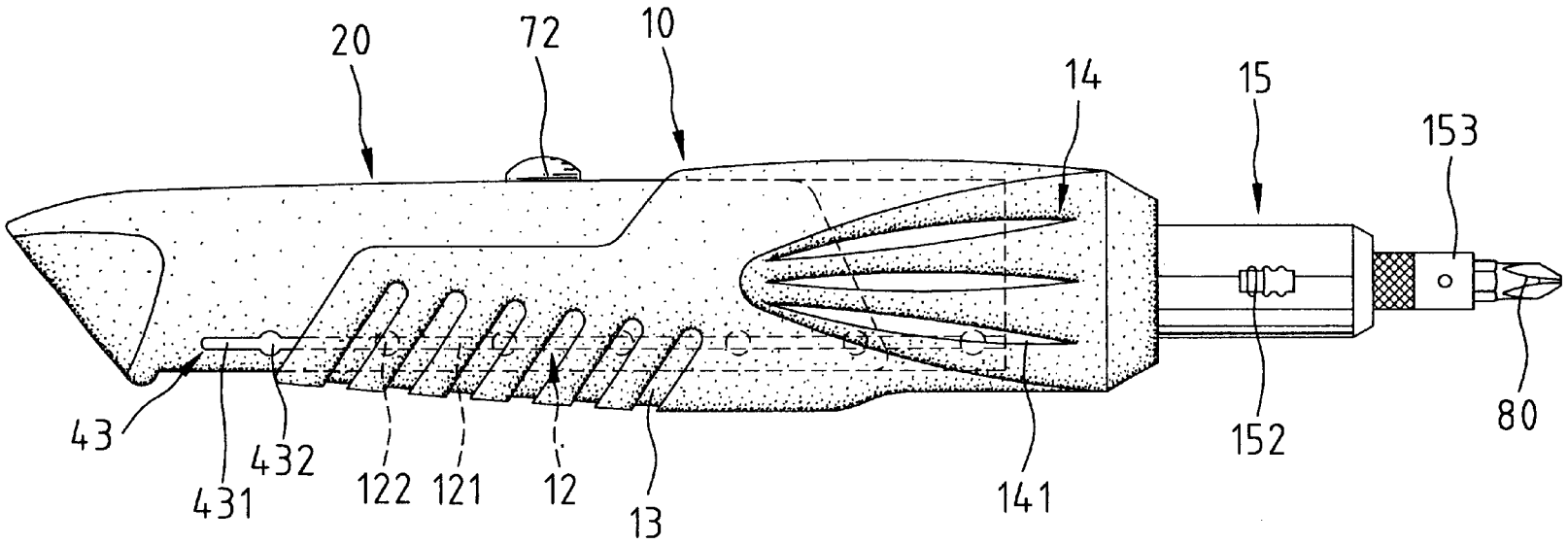
FIG. 8 is a view similar to FIG. 7, wherein a Phillips head bit is attached to the tool coupler.
Figure 9:
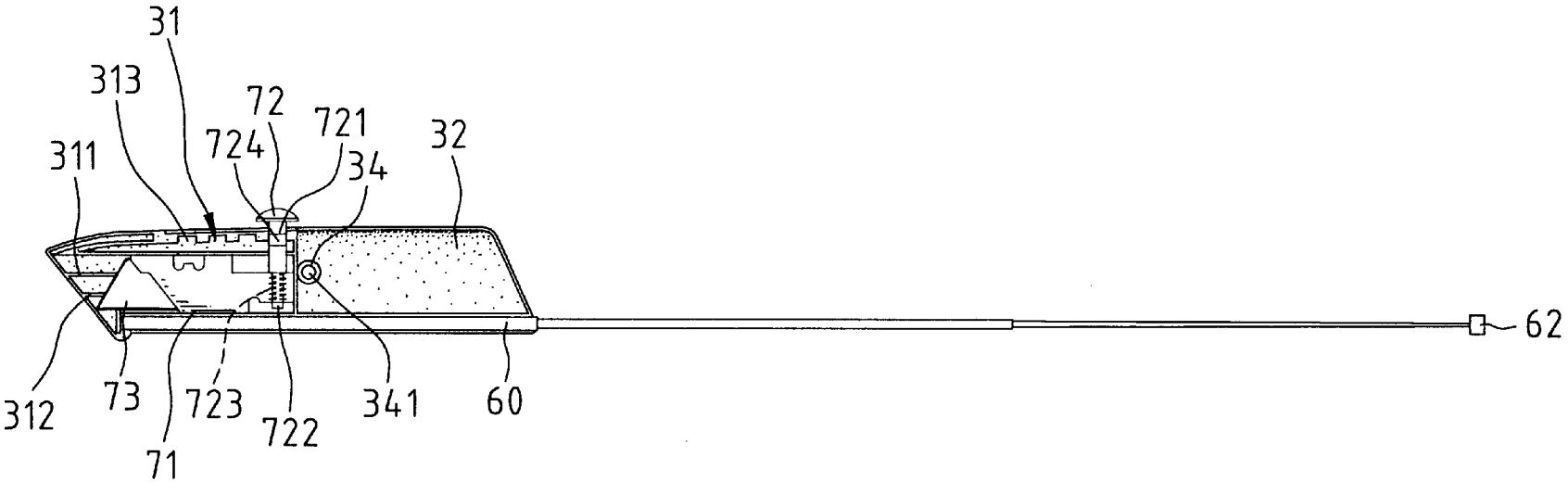
FIG. 9 is a schematic view illustrating use of a telescopic rod with a magnetic end for attracting screws.

Referring to FIGS. 7 and 8, the casing 20 may be manually pulled away from the sleeve 10 until the protrusions 121 and 122 of the rails 12 of the sleeve 10 engage with another positioning depressions 432. Thus, the sleeve 10 and the casing 20 are adjusted in the longitudinal direction and retained in the required position. The overall length of the tool coupler/knife combination can be adjusted to change the arm of force for cutting objects or driving fasteners. In FIG. 8, a Phillip head tip 80 is engaged with the bit holder 153 of the tool bit coupler 15 for driving screws. FIG. 9 illustrates use of the telescopic rod 60, wherein the telescopic rod 60 may be extended to a desired extent such that the magnetic end 62 may be used for retrieving a screw (not shown) that is inadvertently fallen into a difficult-to-access position.

According to the above description, it is appreciated that the tool coupler/knife combination in accordance with the present invention can be firmly grasped and the arm of force can be adjusted to provide easy cutting or fastener driving. In addition, the telescopic rod with a magnetic end may be used for attracting screws when required.

Although the invention has been explained in relation to its preferred embodiment, it is to be understood that many other possible modifications and variations can be made without departing from the spirit and scope of the invention as hereinafter claimed.

What is claimed is:

1. A tool coupler/knife combination comprising:

a sleeve;

a casing slidably mounted in the sleeve and having a blade mounted therein, the blade being slidable relative to the casing to a position in which an end of the blade is exposed for cutting; and means for retaining the casing in one of a plurality of longitudinally spaced retaining positions relative to the sleeve;

wherein the casing includes a groove track with a plurality of longitudinally spaced depressions, and wherein the sleeve includes a rail for slidably engaging with the groove track, the rail including a plurality of longitudinally spaced protrusions for releasably engaging with the depressions.

2. A tool coupler/knife combination comprising:

a sleeve including two rails formed on two opposite inner lateral walls thereof, respectively, each said rail including a plurality of longitudinally spaced protrusions;

a casing slidably mounted in the sleeve and including two casing halves, each said casing half having a groove track formed on an outer side thereof, each said groove track including a plurality of longitudinally spaced depressions for releasably engaging with the protrusions of the rails, thereby retaining the casing in one of a plurality of longitudinally spaced retaining positions relative to the sleeve; and a blade mounted in the casing, the blade being slidable relative to the casing to a position in which an end of the blade is exposed for cutting.

3. The tool coupler/knife combination as claimed in claim 2, further comprising a tool coupler mounted to the sleeve for releasably engaging with a tool bit.

4. The tool coupler/knife combination as claimed in claim 3, wherein the tool coupler includes a ratchet shifter.

5. The tool coupler/knife combination as claimed in claim 2, wherein the sleeve includes a plurality of recesses on an outer surface thereof for allowing firm grasp.

6. The tool coupler/knife combination as claimed in claim 2, wherein at least one of the casing halves includes a receptacle for receiving a telescopic rod with a magnetic end for attracting a screw.

7. A tool coupler/knife combination comprising:

a sleeve including two rails formed on two opposite inner lateral walls thereof, respectively, each said rail including a plurality of longitudinally spaced protrusions;

a casing slidably mounted in the sleeve and including two casing halves, each said casing half having a groove track formed on an outer side thereof, each said groove track including a plurality of longitudinally spaced depressions for releasably engaging with the protrusions of the rails, thereby retaining the casing in one of a plurality of longitudinally spaced retaining positions relative to the sleeve, one of the casing halves including a plurality of positioning recesses; and a blade kit mounted in the casing, the blade kit including a blade, a blade holder for holding the blade, and a thumb piece extended beyond the casing for manual operation for moving the blade relative to the casing, the thumb piece including a positioning member and an engaging stem extended from the positioning member, the positioning member including a protrusion for releasably engaging with one of the positioning recesses of the casing, the blade holder including a fixing seat to which the engaging stem is slidably engaged such that the thumb piece is slidable in a vertical direction relative to the fixing seat to thereby allow the protrusion to be disengaged from the positioning recesses when the thumb piece is pushed, an elastic element being mounted around the engaging stem for biasing the protrusion to engage with said one of the positioning recesses of the casing.

8. The tool coupler/knife combination as claimed in claim 7, wherein the knife has two the recesses and the blade holder includes an engaging piece for releasably engaging with one of the recesses of the knife, and wherein an end of the knife is usable when the engaging piece engages with one of the recesses of the knife, and another end of the knife is usable when the engaging piece engages with the other recess of the knife.

9. The tool coupler/knife combination as claimed in claim 7, further comprising a tool coupler mounted to the sleeve for releasably engaging with a tool bit.

10. The tool coupler/knife combination as claimed in claim 9, wherein the tool coupler includes a ratchet shifter.

11. The tool coupler/knife combination as claimed in claim 7, wherein the sleeve includes a plurality of recesses on an outer surface thereof for allowing firm grasp.

12. The tool coupler/knife combination as claimed in claim 7, wherein at least one of the casing halves includes a receptacle for receiving a telescopic rod with a magnetic end for attracting a screw.

13. The tool coupler/knife combination as claimed in claim 7, wherein at least one of the casing halves includes a compartment for receiving spare blades.

14. The tool coupler/knife combination as claimed in claim 7, wherein at least one of the casing halves includes a compartment for receiving tool bits.

* * * * *